United States Patent [19]

Batson

[11] 4,309,929

[45] Jan. 12, 1982

[54] TRIM PRESS HAVING HAMMER DRIVE FOR PUNCH

[75] Inventor: Edward E. Batson, Mesa, Ariz.

[73] Assignee: Leesona Corporation, Beaverton, Mich.

[21] Appl. No.: 122,855

[22] Filed: Feb. 20, 1980

[51] Int. Cl.[3] ..... B26D 5/08

[52] U.S. Cl. ..... 83/554; 83/586; 83/617

[58] Field of Search ..... 83/554, 586, 587, 617

[56] References Cited

U.S. PATENT DOCUMENTS

| | | | |
|---|---|---|---|
| 1,485,961 | 3/1924 | Clarke | 83/554 |
| 2,343,073 | 2/1944 | Morin | 83/554 |
| 2,470,561 | 5/1949 | Hunter . | |
| 2,602,507 | 7/1952 | Adams | 83/587 |
| 3,906,828 | 9/1975 | Suzukie | 83/539 |
| 4,245,493 | 1/1981 | Lindell | 83/587 X |

*Primary Examiner*—James M. Meister

*Attorney, Agent, or Firm*—Learman & McCulloch

[57] ABSTRACT

A trim press employs a hammer assembly to deliver a hammer blow to the punch of the press at the moment the punch begins to apply shearing pressure to material being trimmed. A spring system applies a steadily increasing spring loading to the hammer as the punch carrying platen moves downwardly in its operating stroke toward the die. A latch assembly, triggered by an abutment on the die, unlatches the hammer at the time the punch engages the material so that the downward velocity of the punch due to the downward movement of the platen is increased by a hammer blow as the punch moves through the material being trimmed. The spring system is operable to restore the hammer to its latched position during the upward stroke of the platen.

8 Claims, 2 Drawing Figures

TRIM PRESS HAVING HAMMER DRIVE FOR PUNCH

BACKGROUND OF THE INVENTION

Figure 1:
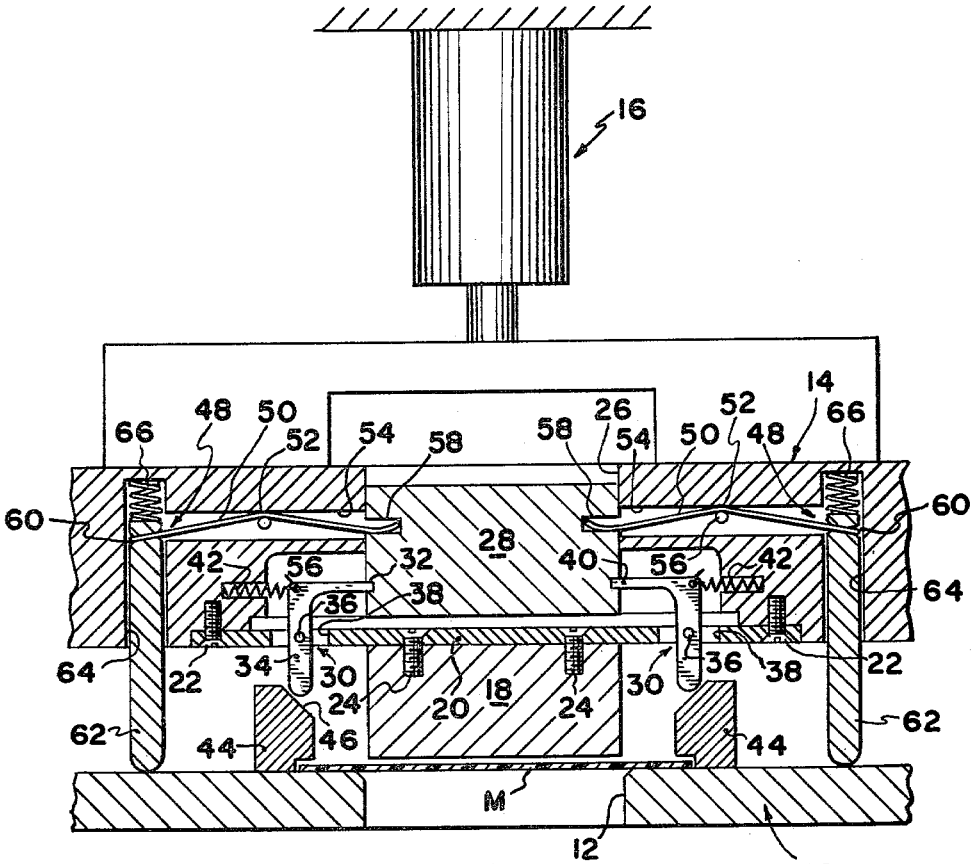

The present invention is specifically concerned with a problem encountered in trimming or punching relatively soft materials such as polypropylene or the like. In order to cleanly shear and trim the material, the punch should move rapidly through the material before the pressure applied to the material by the punch causes any significant amount of flowing of the material under the pressure applied. The speed of movement of the punch carrying platen in its operating stroke is subject to practical limitations, and with relatively soft or relatively easily compressed materials, the material will tend to flow or become deformed before the shearing stroke is completed, resulting in what is generally referred to as a smearing effect.

The present invention is designed to provide an instantaneous and temporary acceleration to the punch as it moves through the material being trimmed, with the objective of completing the shearing of the material before any substantial flowing or deformation takes place, and to accomplish this without requiring any acceleration or increased velocity of the relatively massive punch carrying platen.

SUMMARY OF THE INVENTION

In accordance with the present invention, the punch is mounted upon the platen by means of a diaphragm or plate which is capable of some flexing movement so that the punch is capable of at least a limited degree of vertical movement relative to the platen. A hammer is slidably mounted in the platen above the punch and is normally maintained, by a releasable latch assembly, at a slightly elevated vertically spaced relationship to the diaphragm immediately above the punch. Plunger members resting upon the die project upwardly through vertical passages in the platen and have their upper ends engaged with generally horizontally extending leaf springs which are fulcrumed on the platen at their central portion and have their opposite ends engaged in generally horizontal recesses in the hammer. When the platen moves downwardly, the plungers move upwardly relative to the platen, causing the leaf springs to apply a steadily increasing downward biasing force upon the hammer as the platen moves downwardly. Abutments mounted upon the die member engage the latch assemblies to release the latch as the punch moves into contact with material operatively located on the die. The hammer thus is spring biased to deliver a hammer blow to the punch upon release of the latches, to thereby impart an instanteous acceleration to the punch as it moves through the material being trimmed. Upon upward movement of the die, the plungers cause the leaf springs to swing about their fulcrums on the platen to lift the hammer upwardly until the latches can reengage to lock the hammer in its cocked position.

Other objects and features of the invention will become apparent by reference to the following specification and to the drawings.

Figure 2:
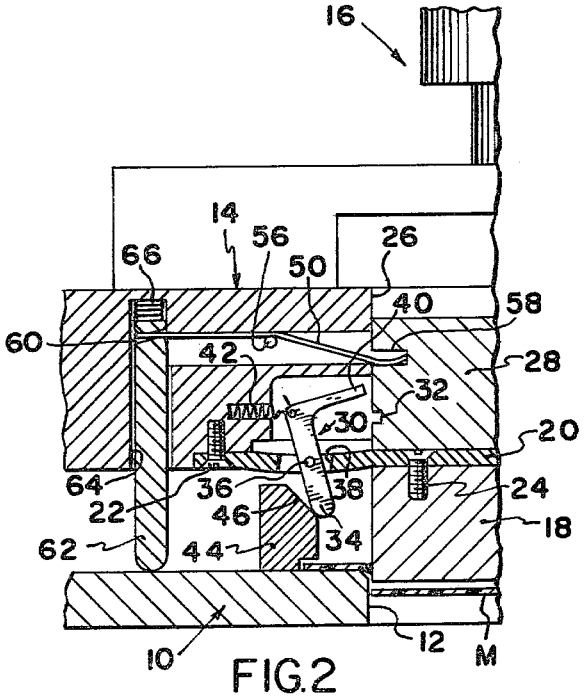

In the drawings:

FIG. 1 is a detailed cross-sectional view taken on a vertical plane through the platen, punch and die region of an otherwise conventional trim press embodying the present invention; and FIG. 2 is a cross-sectional view similar to FIG. 1, showing the hammer assembly in its actuated condition.

Because the invention here to be described involves only modifications to the platen and the die of a conventional trim press, only these portions of the press have been illustrated in the drawings. Reference may be had, for example, to U.S. Pat. No. 3,461,760, for example, for details of the trim press structure not shown in the present application.

Referring to the drawings, there is illustrated in cross-section a stationary die designated generally 10, having a die passage 12 extending vertically through the die. A platen designated generally 14 is located above the die and is supported in a well known manner on the machine frame (not shown) for vertical reciprocatory movement toward and away from the upper surface of die 10. Platen 14 is driven in vertical reciprocatory movement by a suitable drive schematically indicated at 16, such drive means being well known to those skilled in the art. A punch designated generally 18 is mounted upon the lower side of platen 14 by a metal plate or diaphragm 20 which is fixedly secured to the underside of platen 14 as by machine screws 22 so that the central portion of the plate or diaphragm 20 to which punch 18 is fixedly secured by machine screws 24, can flex to accommodate limited vertical movement of punch 18 relative to platen 14. The punch 18 is formed to enter the opening or passage 12 to die 10 and, upon downward movement of the platen, the lower end of the punch cooperates with the edges of die passage 12 to shear or trim material from a web of material M which over lies the upper end of die passage 12.

Platen 14 is formed with a vertical passage 26 vertically aligned with punch 18, and a hammer 28 is slidably received within passage 26. Hammer 28 is normally latched against vertical movement relative to platen 14 by latch assemblies designated generally 30 engaged in recesses 32 formed in hammer 28. Hammer 28 is shown in its normal position in FIG. 1 with latch assemblies 30 engaged in recesses 32, and it will be noted that in this normal position, the lower end of the hammer 28 is spaced above the upper side of diaphragm 20.

Each latch assembly 30 includes a pivoted latch member 34, mounted by a pivot pin 36 on diaphragm 20, diaphragm 20 having vertical passages therethrough as at 38 to accommodate pivotal movement of the latch member about its pivot 36. Each latch member 34 includes a tooth portion 40 adapted to be received within the recesses 32 in hammer 28. Compression springs 42 seated in platen 14 resiliently bias the latch member 34 in pivotal movement urging the tooth portion 40 toward its seated position in recess 32.

The latch members are automatically released or disengaged from hammer 28 during the downward stroke of the platen by abutment members 44 which are fixedly mounted on the stationary die 10 and formed with inclined latch actuating surfaces 46 which engage the lower ends of latch members 34 as the platen moves downwardly to pivot latch members 34 to their release position, shown in FIG. 2, when the platen reaches a predetermined elevation relative to die 10. This elevation is chosen so that latch members 34 are disengaged from hammer 28 just as the punch 18 initially engages the upper surface of the material M to be trimmed.

Because the platen of a typical trim press is of substantial weight and is driven, as by drive means 16, in a relatively short reciprocatory stroke, the speed at which the platen is driven is subject to practical limitations in that the platen must reverse direction at each end of its stroke. Reversal of direction of movement of the platen thus imposes a substantial load on its drive mechanism during stroke reversal, which load increases substantially with increases of the velocity of the platen during the stroke. This practical limitation on the velocity of the platen creates a problem in the trimming of soft or easily compressible plastics or other materials in that as the punch moves through the material, the material becomes compressed and can flow or deform during the time interval while the punch is actually shearing through the material. If the material being trimmed has a sufficient opportunity to flow or shift as the punch is passing through it, a clean cut or smooth edge is not obtained.

The present invention employs a plunger actuated spring mechanism designated generally 48 which, in cooperation with the releasable latch assemblies described above, is operable to deliver a hammer blow to the punch to impart a short term acceleration to the punch as it is moving through the material to effectively substantially increase the shearing velocity of the punch without imposing any substantial additional loading to the drive mechanism at the stroke reversal point of the platen subsequent to the trimming or shearing operation.

Each plunger actuated spring mechanism 48 includes a leaf spring 50, which preferably is bowed upwardly as at 52 at an intermediate portion. Springs 50 pass through horizontal passages 54 in platen 14, and preferably fulcrum pins 56 mounted in the platen hold the bowed portion 52 of the springs in contact with the upper wall of passage 54 so that the spring is capable of pivotal movement accommodating up and down motion of its opposite ends relative to platen 14.

Hammer 28 is formed with recesses 58 in which one end of each spring 50 is engaged, while the opposite end of each spring 50 is engaged within a slot 60 formed in the upper end of each of a group vertically disposed plungers 62 which are slidably received within bores 64 in platen 14 for vertical movement relative to the platen. The lower ends of plungers 62 rest upon the upper surface of die 10 and compression springs 66 at the upper ends of bores 64 resiliently bias the plungers 62 downwardly against the stationary die 10.

Operation of the hammer blow applying mechanism is as follows. Referring to FIG. 1, it is assumed that platen 14 is moving downwardly in an operating stroke toward the stationary die 14. As platen 14 moves downwardly, plungers 62, which rest upon the stationary die 10, remain stationary. Plungers 62 thus hold those ends of leaf springs 50 seated in the plunger slots 60 stationary, while the downwardly moving platen presses upon and moves the upper bowed portions 52 of the leaf springs 50 downwardly, thus loading the springs and causing the ends of spring 50 seated in recesses 58 of hammer 28 to apply a downward biasing action on hammer 28. Hammer 28 is, however, firmly latched at this time to platen 14 by latch members 34. As the platen continues to move downwardly in its operating stroke, the downward biasing force applied by springs 50 to hammer 28 steadily increases.

Eventually, downward movement of the platen drives the lower ends of latch members 34 into engagement with the inclined surfaces 46 on abutments 44 and further downward movement of platen 14 causes the surfaces 46 to cam the pivoted latch members 34 to their latch release position shown in FIG. 2. When latch teeth 40 become disengaged from recesses 32 in hammer 28, the stored spring force exerted by springs 50 on hammer 28 can now act to drive hammer 28 downwardly with a substantial force to cause hammer 28 to strike a hammer blow on diaphragm 20 which is transmitted by flexing of the diaphragm to punch 18. This imparts an instantaneous acceleration to the punch which is caused to be applied, by the location of abutment surfaces 46, to the punch as the punch is just entering the material M being trimmed. Thus, the velocity of the punch as it passes through the material M is substantially increased.

Because the effect of this velocity increase is substantially dissipated by the time the punch completes the shearing operation; at the subsequent stroke reversal of the platen to its upward or return stroke, the drive mechanism faces only the normal stroke reversal forces.

As the platen moves upwardly, springs 66 maintain plungers 62 in contact with the upper surface of die 10, and thus again the plungers remain stationary as the platen moves upwardly. Fulcrum pins 56 on the platen carry the central portion of springs 50 upwardly during this upward stroke of the platen, thus tending to elevate those ends of springs 50 engaged within the recesses 58 in hammer 28. This action elevates hammer 28 relative to the platen to a position such that latch teeth 40 of latch members 34 can re-enter latch recesses 32 in the hammer under the influence of their biasing springs 42.

The foregoing description has, for purposes of simplicity, been limited to a situation in which the platen has been described as moving vertically relative to a horizontally disposed die member. It is believed apparent, however, that the mechanism described above is equally well operable in the case where the platen would be mounted for horizontal movement toward and away from a generally vertically disposed die plate, as, for example, in the case of U.S. Pat. No. 3,461,760 referred to above. Therefore, it is to be understood that references to vertical movement, downward movement, upwardly or downwardly facing, etc. are solely for establishing a reference frame for stating orientation of various parts relative to each other and that is is not intended to foreclose coverage of similar structure in a horizontal orientation.

While one embodiment of the invention has been described in detail, it will be apparent to those skilled in the art that the disclosed embodiment may be modified, as, for example, mounting the mechanism for movement in a horizontal direction rather in the vertical direction described above.

I claim:

1. In a trim press having a die with an opening therein, a platen mounted for reciprocatory movement relative to said die, and a punch carried by said platen and movable into and out of said opening in said die upon reciprocation of said platen to shear or sever material overlying said die and the edge of said opening; the improvement comprising means mounting said punch on said platen for limited movement relative to said platen, a hammer mounted on said platen for movement relative to said platen and said punch, releasable latch means engageable with said hammer and operable when engaged with said hammer to releasably latch said hammer against movement relative to said platen, first spring means mounted on said platen and connected with said hammer operable upon movement of said platen to exert a biasing force on said hammer which is steadily increased in response to movement of said platen; and means for releasing said latch means to permit said first spring means to drive said hammer relative to said platen to strike a hammer blow to said punch when said punch is at a predetermined position relative to said die.

2. The invention defined in claim 1 wherein said first spring means comprises a plunger slidably mounted in said platen for reciprocatory movement relative to said platen and having a first end engaged with and supported upon a surface of said die, a first surface on said hammer, a second surface on said plunger, a third surface on said platen located between said first and second surfaces, and a leaf spring having a central portion in engagement with said third surface and having opposite end portions respectively resting upon said first and said second surfaces.

3. The invention defined in claim 2 further comprising means defining a spring receiving passage extending through said platen from said plunger to said hammer accommodating movement of said opposite end portions of said leaf spring relative to said platen while confining said central portion against movement relative to said platen, and means defining first and second surfaces on said hammer and said plunger in spaced opposed relationship respectively to said first and second surfaces on the hammer and plunger with said opposite end portions of said leaf spring engaged beneath said first and second surfaces on the hammer and plunger whereby movement of said plunger relative to said platen causes said leaf spring to apply a force to said hammer and movement of said plunger relative to said platen causes said leaf spring to apply an oppositely directed force to said hammer.

4. The invention defined in claim 3 further comprising second spring means resiliently biasing said plunger toward said die.

5. The invention defined in claim 1 wherein said means mounting said punch upon said platen comprises a plate member fixedly secured at opposite ends to said platen, and means fixedly mounting said punch upon the central portion of said plate member whereby limited movement of said punch relative to said platen is accommodated by flexing of said plate member.

6. The invention defined in claim 1 wherein said latch means comprises a latch member pivotally mounted upon said platen and having a tooth portion movable into and out of latching engagement with a recess in said hammer upon pivotal movement of said latch member, and an arm portion on said latch member projecting from said platen, and wherein said latch release means comprises an abutment on said die means engageable with said arm portion in response to movement of said platen relative to said die for pivoting said latch member to move said tooth portion out of latching engagement with said recess when said platen is moved to a predetermined elevation relative to said die.

7. The improvement defined in claim 1 wherein the means for releasing said latch means comprises a platen position sensor on said die, operable to release said latch means when the platen is moved toward the die sufficiently to store energy in said hammer and cause the punch to just enter the material being trimmed.

8. The improvement set forth in claim 7 wherein said sensor comprises an inclined cam surface engaged by said latch means upon a predetermined movement of the platen toward the die.

* * * * *